US008995853B2

(12) United States Patent
Nakae

(10) Patent No.: US 8,995,853 B2
(45) Date of Patent: Mar. 31, 2015

(54) TRANSFER DEVICE AND IMAGE FORMING APPARATUS INCLUDING TRANSFER DEVICE

(71) Applicant: KYOCERA Document Solutions Inc., Osaka-shi, Osaka (JP)

(72) Inventor: Sadanori Nakae, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/092,325

(22) Filed: Nov. 27, 2013

(65) Prior Publication Data

US 2014/0153940 A1 Jun. 5, 2014

(30) Foreign Application Priority Data

Nov. 30, 2012 (JP) ..... 2012-261967

(51) Int. Cl.
*G03G 15/00* (2006.01)
*G03G 15/16* (2006.01)
*G03G 15/01* (2006.01)

(52) U.S. Cl.
CPC ..... *G03G 15/167* (2013.01); *G03G 15/0189* (2013.01); *G03G 15/5054* (2013.01)
USPC ..... 399/44; 399/66; 399/8; 399/9

(58) Field of Classification Search
CPC ..... G03G 15/167; G03G 15/1089; G03G 15/5054
See application file for complete search history.

(56) References Cited

U.S. PATENT DOCUMENTS

2004/0156653 A1* 8/2004 Takehara ..... 399/167
2007/0172258 A1* 7/2007 Matayoshi ..... 399/167
2008/0159761 A1* 7/2008 Haruyama et al. ..... 399/44

FOREIGN PATENT DOCUMENTS

JP 2004219489 8/2004
JP 2006-259551 9/2006
JP 2007102137 4/2007

(Continued)

OTHER PUBLICATIONS

Machine Translation of the Abstract.*

(Continued)

*Primary Examiner* — Clayton E Laballe
*Assistant Examiner* — Ruifeng Pu
(74) *Attorney, Agent, or Firm* — Gerald E. Hespos; Michael J. Porco; Matthew T. Hespos

(57) ABSTRACT

A transfer device includes an intermediate transfer belt, a driving roller, an environment sensor, a resistance detecting sensor, and a speed ratio adjusting section. The toner images are transferred from the plurality of image carriers onto a surface of the intermediate transfer belt in a superimposed manner. The driving roller circumferentially and rotationally drives the intermediate transfer belt. The environment sensor detects a temperature or a humidity around the intermediate transfer belt. The resistance detecting section detects a change in a resistance value of the intermediate transfer belt. The speed ratio adjusting section controls a rotation speed of the driving roller according to results of detection by the environment sensor and the resistance detecting section, thereby adjusting a speed ratio Vb/Vd between a circumferential rotating speed Vb of the intermediate transfer belt and a rotation speed Vd of the image carrier.

14 Claims, 6 Drawing Sheets

(56) References Cited

FOREIGN PATENT DOCUMENTS

| | | | |
|---|---|---|---|
| JP | 2009258378 | | 11/2009 |
| JP | 2012159673 A | * | 8/2012 |

OTHER PUBLICATIONS

Japanese Patent Appl. No. 2012-261967—Office Action issued on Dec. 2, 2014.

* cited by examiner

TRANSFER DEVICE AND IMAGE FORMING APPARATUS INCLUDING TRANSFER DEVICE

The application is based on Japanese Patent Application No. 2012-261967 filed at the Japanese Patent Office on Nov. 30, 2012, and the contents thereof are incorporated herein by reference.

BACKGROUND

The disclosure relates to a transfer device with an intermediate transfer belt that carries a toner image and an image forming apparatus including the transfer device.

An electrophotographic image forming apparatus is known which includes a photosensitive drum that carries an electrostatic latent image and a transfer device that transfers a toner image from the photosensitive drum to a sheet. To transfer an image in a plurality of colors to the sheet, the transfer device includes an intermediate transfer belt, a primary transfer member, and a secondary transfer member. The intermediate transfer belt rotates circumferentially opposite a plurality of photosensitive drums. A primary transfer voltage applied to the primary transfer member allows the toner image to be transferred from each of the photosensitive drums onto the intermediate transfer belt. Then, a secondary transfer voltage applied to the secondary transfer member allows the toner images to be transferred from the intermediate transfer belt to the sheet at a time. Furthermore, a technique is known in which, to inhibit possible color misalignment in a high or low humidity environment, the rotation speeds of the photosensitive members for the respective colors are individually adjusted to rank the speed ratios between the intermediate transfer belt and the photosensitive members.

SUMMARY

A transfer device according to an aspect of the disclosure includes an intermediate transfer belt, a driving roller, an environment sensor, a resistance detecting sensor, and a speed ratio adjusting section. The intermediate transfer belt is disposed to face a plurality of image carriers each carrying a toner image on a circumferential surface of the image carrier and moreover rotationally driven at an equal speed. The intermediate transfer belt is circumferentially and rotationally driven in one direction. The toner images from the plurality of image carriers are transferred onto a surface of the intermediate transfer belt in a superimposed manner. The intermediate transfer belt is supported around the driving roller, and the driving roller circumferentially and rotationally drives the intermediate transfer belt. The environment sensor detects a temperature or a humidity around the intermediate transfer belt. The resistance detecting section detects a change in a resistance value of the intermediate transfer belt. The speed ratio adjusting section controls a rotation speed of the driving roller according to results of detection by the environment sensor and the resistance detecting section, thereby adjusting a speed ratio Vb/Vd between a circumferential rotating speed Vb of the intermediate transfer belt and a rotation speed Vd of the image carrier.

Furthermore, an image forming apparatus according to another aspect of the disclosure includes the above-described transfer device, the above-described plurality of image carriers, and a secondary transfer roller. The secondary transfer roller transfers the toner images from the intermediate transfer belt to a sheet.

DETAILED DESCRIPTION

An image forming apparatus 10 according to an embodiment of the disclosure will be described below in detail with reference to the drawings. The present embodiment illustrates a tandem color printer as an example of an image forming apparatus. The image forming apparatus may be, for example, a copier, a facsimile machine, and a multifunction machine including a copier and a facsimile machine.

Figure 1:
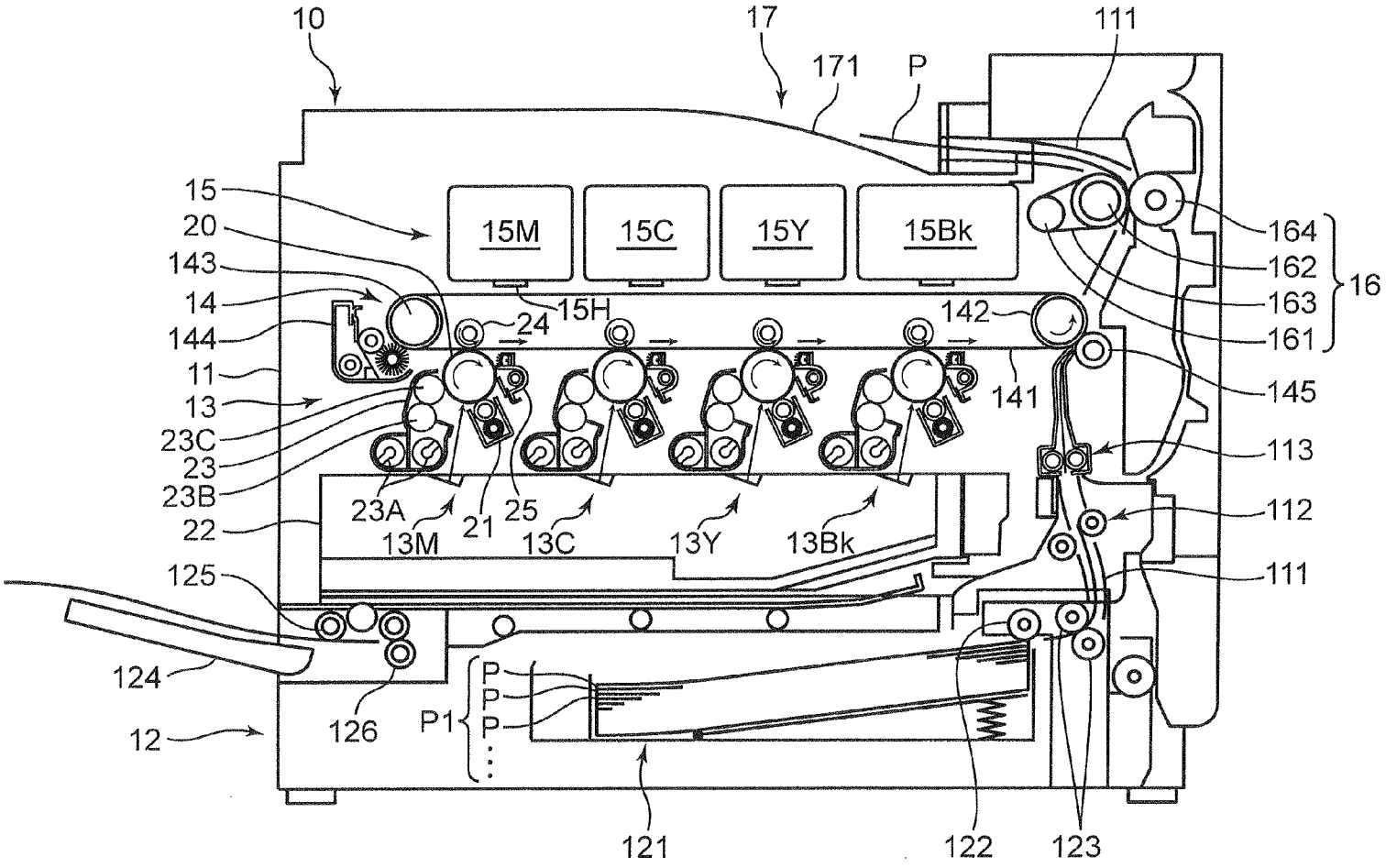
FIG. 1 is a cross-sectional view showing the internal structure of an image forming apparatus according to an embodiment of the disclosure.
Figure 2:
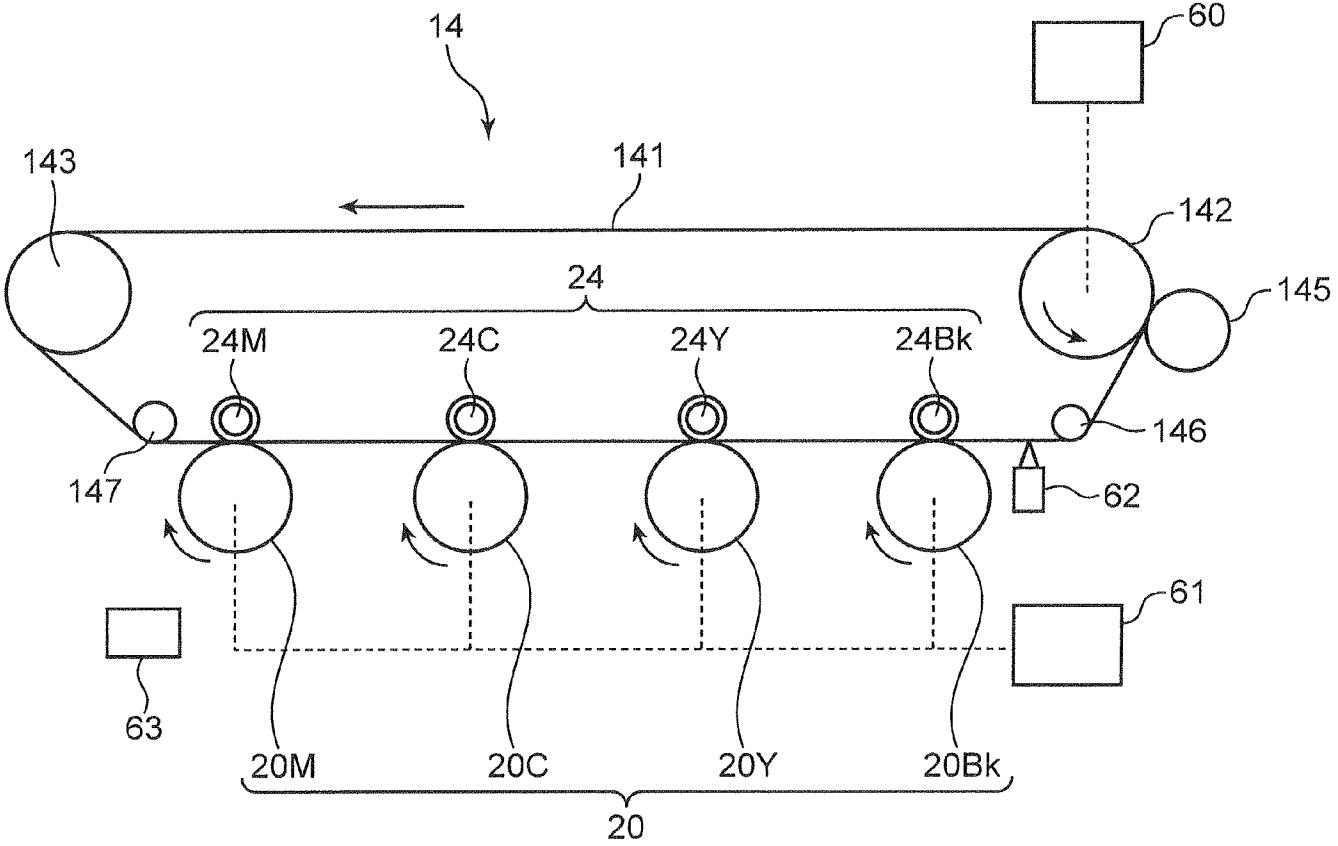
FIG. 2 is a schematic cross-sectional view showing a peripheral portion of an intermediate transfer unit according to the embodiment of the disclosure.

FIG. 1 is a cross-sectional view showing the internal structure of the image forming apparatus 10. Furthermore, FIG. 2 is a schematic cross-sectional view showing a peripheral portion of an intermediate transfer unit 14 inside the image forming apparatus 10. The image forming apparatus 10 includes an apparatus main body 11 with a box-shaped housing structure. The apparatus main body 11 contains a sheet feeding section 12 that feeds a sheet P, an image forming section 13 that forms a toner image to be transferred onto the sheet P fed from the sheet feeding section 12, an intermediate transfer unit 14 (transfer device) to which the toner image is primarily transferred, a secondary transfer roller 145, a toner supply section 15 that supplies toner in the image forming section 13, and a fixing section 16 that carries out a process of fixing an unfixed image formed on the sheet P, to the sheet P. Moreover, a sheet discharge section 17 into which that the sheet P on which a fixing process has been carried out by the fixing section 16 is discharged is provided above the apparatus main body 11.

An operation panel (not shown in the drawings) is provided on an upper surface of the apparatus main body 11 at an appropriate position so that an operation of inputting, for example, output conditions for the sheet P is performed via the operation panel. The operation panel includes a power supply key, and a touch panel and various operations keys via which the output conditions are input.

Moreover, in the apparatus main body 11, a sheet conveying path 111 extending in an up-down direction is formed to at a right-hand position with respect to the image forming section 13. A conveying roller pair 112 is provided at an appropriate position on the sheet conveying path 111 to convey the sheet to an appropriate position. Furthermore, a registration roller pair 113 is provided on the sheet conveying path 111 upstream of a secondary transfer nip portion, which is described later, to carry out skew correction on the sheet and to feed the sheet into the nip portion at a predetermined timing. The sheet conveying path 111 is a conveying path along which the sheet P is conveyed from the sheet feeding section 12 to the sheet discharge section 17 via the image forming section 13 and the fixing section 16.

The sheet feeding section 12 includes a sheet feeding tray 121, a pickup roller 122, and a sheet feeding roller pair 123. The sheet feeding tray 121 is removably installed at a lower position in the apparatus main body 11 so that a bundle of sheets P1 with a plurality of sheets P stacked therein can be stored in the sheet feeding tray 121. The pickup roller 122 sends out the uppermost sheet P of the bundle of sheets P1 stored in the sheet feeding tray 121 one by one. The sheet feeding roller pair 123 feeds the sheet P sent out by the pickup roller 122 out to the sheet conveying path 111.

The sheet feeding section 12 includes a manual sheet feeding section attached to left-hand side surface of the apparatus main body 11 shown in FIG. 1. The manual sheet feeding section includes a manual feed tray 124, a pickup roller 125, and a sheet feeding roller pair 126. The manual feed tray 124 is a tray on which the sheet P to be manually fed is placed and which is opened from a side surface of the apparatus main body 11 as shown in FIG. 1 when the sheet P is manually fed. The pickup roller 125 sends out the sheet P placed on the manual feed tray 124. The sheet feeding roller pair 126 feeds the sheet P sent out by the pickup roller 125 out to the sheet conveying path 111.

The image forming section 13 forms a toner image to be transferred to the sheet P, and includes a plurality of image forming units forming toner images in different colors. As the image forming units, the present embodiment includes a magenta unit 13M using a magenta (M) developer, a cyan unit 13C using a cyan (C) developer, a yellow unit 13Y using a yellow (Y) developer, and a black unit 13Bk using a black (Bk) developer; the magenta unit 13M, the cyan unit 13C, the yellow unit 13Y, and the black unit 13Bk are sequentially disposed from an upstream side toward a downstream side (from a left-hand side to a right-hand side shown in FIG. 1) in a rotating direction (circumferential rotating direction) of an intermediate transfer belt 141 described below. Each of the units 13M, 13C, 13Y, and 13Bk includes a photosensitive drum 20 (image carrier), and a charging device 21, a developing device 23, and a cleaning device 25 disposed around the photosensitive drum 20. Furthermore, an exposure device 22 common to the units 13M, 13C, 13Y, and 13Bk is disposed below the image forming units.

The photosensitive drum 20 is rotationally driven around a shaft thereof. An electrostatic latent image and a toner image are formed on a peripheral surface of the photosensitive drum 20. The photosensitive drum 20 may be a photosensitive drum formed of a material containing amorphous silicon (a-Si). As shown in FIG. 2, photosensitive drums 20M, 20C, 20Y, and 20Bk are disposed in association with the image forming units for the respective colors. The charging device 21 uniformly charges a surface of the photosensitive drum 20. The charging device 21 is a charging device based on a contact charging scheme and including a charging roller and a charge cleaning brush for removing toner attached to the charging roller. The exposure device 22 has various types of optical equipment such as a light source, a polygon mirror, a reflection mirror, and a deflection mirror. The exposure device 22 irradiates the uniformly charged peripheral surface of the photosensitive drum 20 with light modulated based on image data to form an electrostatic latent image. The photosensitive drum 20 is rotationally driven by a drum motor 61 (FIG. 2). According to the present embodiment, the photosensitive drums 20 corresponding to the image forming units for the respective colors are rotationally driven by the drum motor 61 at an equal speed. Additionally, the cleaning device 25 cleans the peripheral surface of the photosensitive drum 20 after transfer of a toner image.

In order to develop an electrostatic latent image formed on the photosensitive drum 20, the developing device 23 supplies toner to the peripheral surface of the photosensitive drum 20. The developing device 23 is for two-component developer containing toner and a carrier, and includes two agitating rollers 23A, a magnetic roller 23B, and a developing roller 23C. The agitating rollers 23A cyclically convey and agitate the two-component developer to charge the toner. A two-component developer layer is carried on a peripheral surface of the magnetic roller 23B. A toner layer is carried on a peripheral surface of the developing toner 23C; the toner layer is formed when the toner is delivered from the magnetic roller 23B to the developing toner 23C due to a potential difference between the magnetic roller 23B and the developing roller 23C. The toner on the developing roller 23C is supplied to the peripheral surface of the photosensitive drum 20, and the electrostatic latent image is developed. According to the present embodiment, the toner is characterized by being charged to a positive polarity.

The intermediate transfer unit 14 is disposed in a space provided between the image forming section 13 and the toner supply section 15. As shown in FIG. 2, the intermediate transfer unit 14 includes an intermediate transfer belt 141, a driving roller 142, a driven roller 143, and a primary transfer roller 24.

The intermediate transfer belt 141 is an endless belt-like rotator and is stretched and supported around the driving roller 142 and the driven roller 143 so that a peripheral surface side of the intermediate transfer belt 141 comes into abutting contact with the peripheral surface of each photosensitive drum 20. The intermediate transfer belt 141 is a conductive soft belt with a stack structure including a base layer, an elastic layer, and a coat layer. The base layer forms the lowermost layer of the intermediate transfer belt 141. The base layer is preferably, for example, polyvinylidene difluoride (PVDF) or a polyimide resin. The elastic layer applies appropriate elasticity to the intermediate transfer belt 141. A material for the elastic layer is, for example, hydrin rubber, chloroprene rubber, or polyurethane rubber. Furthermore, the coat layer forms the uppermost layer of the intermediate transfer belt 141 and comes into contact with the photosensitive drum 20 (FIG. 1). The coat layer protects the elastic layer, and a material for the coat layer is acryl, silicon, or a fluorine resin such as PTFE.

The driving roller 142 is located at a right end side of the intermediate transfer unit 14. The intermediate transfer belt 141 is stretched and supported around and driven by the driving roller 142 for circumferential rotation. The driving roller 142 is provided with a rotational driving force by a belt motor 60 described below. The driving roller 142 is formed of a metal roller.

More specifically, the driving roller 142 has a two-layer structure in a cross-sectional direction. An inner layer of the driving roller 142 is formed of an aluminum layer. Furthermore, an alumite layer forming a surface layer of the driving roller 142 is provided on the aluminum layer. According to the present embodiment, the alumite layer is an alumite coated film corresponding to the anodized aluminum layer. When the intermediate transfer belt 141 is internally supported with the alumite layer in contact with an inner peripheral surface of the intermediate transfer belt 141, a rotational driving force is suitably transmitted from the driving roller 142 to the intermediate transfer belt 141.

A well-known film formation method may be used to form an alumite film forming the alumite layer. According to the present embodiment, an element pipe formed of an aluminum pipe is used, and an alumite film is formed on a surface of the element pipe by an anodization method using dilute sulfuric acid as an electrolyte. The film formation results in a porous film formed on the surface of the alumite film and including a barrier layer and a countless number of fine pores. If the fine pores remain open, foreign matter and humic substances may be absorbed by the film. Thus, preferably a sealing process is carried out as aftertreatment. This allows the fine pores in the surface of the film to be occluded, improving corrosion resistance, weather resistance, and contamination resistance.

The driven roller 143 is located at a left end side of the intermediate transfer unit 14, and the intermediate transfer belt 141 is stretched and supported around the driven roller 143. The driven roller 143 applies tension to the intermediate transfer belt 141. A belt cleaning device 144 (FIG. 1) is disposed near the driven roller 143 to remove toner remaining on the peripheral surface of the intermediate transfer belt 141.

The primary transfer roller 24 forms the primary transfer nip portion with the photosensitive drum 20 across the intermediate transfer belt 141. The primary transfer roller 24 primarily transfers a toner image on the photosensitive drum 20 onto the intermediate transfer belt 141. As shown in FIG. 2, primary transfer rollers 24M, 24C, 24Y, and 24Bk are disposed opposite the photosensitive drums 20 for the respective colors. The primary transfer nip portion is formed between each photosensitive drum 20 and the corresponding primary transfer roller 24.

A secondary transfer roller 145 is disposed opposite the driving roller 142. The secondary transfer roller 145 is compressed against the peripheral surface of the intermediate transfer belt 141 to form a secondary transfer nip portion. The toner image primarily transferred onto the intermediate transfer belt 141 is secondarily transferred, at the secondary transfer nip portion, to the sheet P fed from the sheet feeding section 12. According to the present embodiment, the secondary transfer roller 145 is formed of epichlorohydrin.

The toner supply section 15 stores toner used for image formation, and according to the present embodiment, includes a magenta toner container 15M, a cyan toner container 15C, a yellow toner container 15Y, and a black toner container 15Bk. The toner containers 15M, 15C, 15Y, and 15Bk store refill toner in the respective colors M, C, Y, and Bk, and supply toner in the respective colors to the developing devices 23 of the corresponding image forming units 13M, 13C, 13Y, and 13Bk for the respective colors M, C, Y, and Bk, through toner discharge ports 15H formed in bottom surfaces of the corresponding containers and through toner conveying sections (not shown in the drawings).

The fixing section 16 includes a heating roller 161 with a heating source provided inside, a fixing roller 162 disposed opposite the heating roller 161, a fixing belt 163 stretched and supported around the fixing roller 162 and the heating roller 161, and a pressing roller 164 disposed opposite the fixing roller 162 across the fixing belt 163 to form a fixing nip portion. The sheet P fed to the fixing section 16 passes through the fixing nip portion, where the sheet P is heated and pressurized. Thus, the toner image transferred to the sheet P at the secondary transfer nip portion is fixed to the sheet P.

The sheet discharge section 17 is a recessed portion of a top portion of the apparatus main body 11 including a sheet discharge tray 171 formed at a bottom portion of the recess portion and in which the discharged sheet P is received. The sheet P on which a fixing process has been carried out passes along the sheet conveying path 111 extending from the upper portion of the fixing section 16 and is then discharged toward the sheet discharge tray 171.

Figure 3:
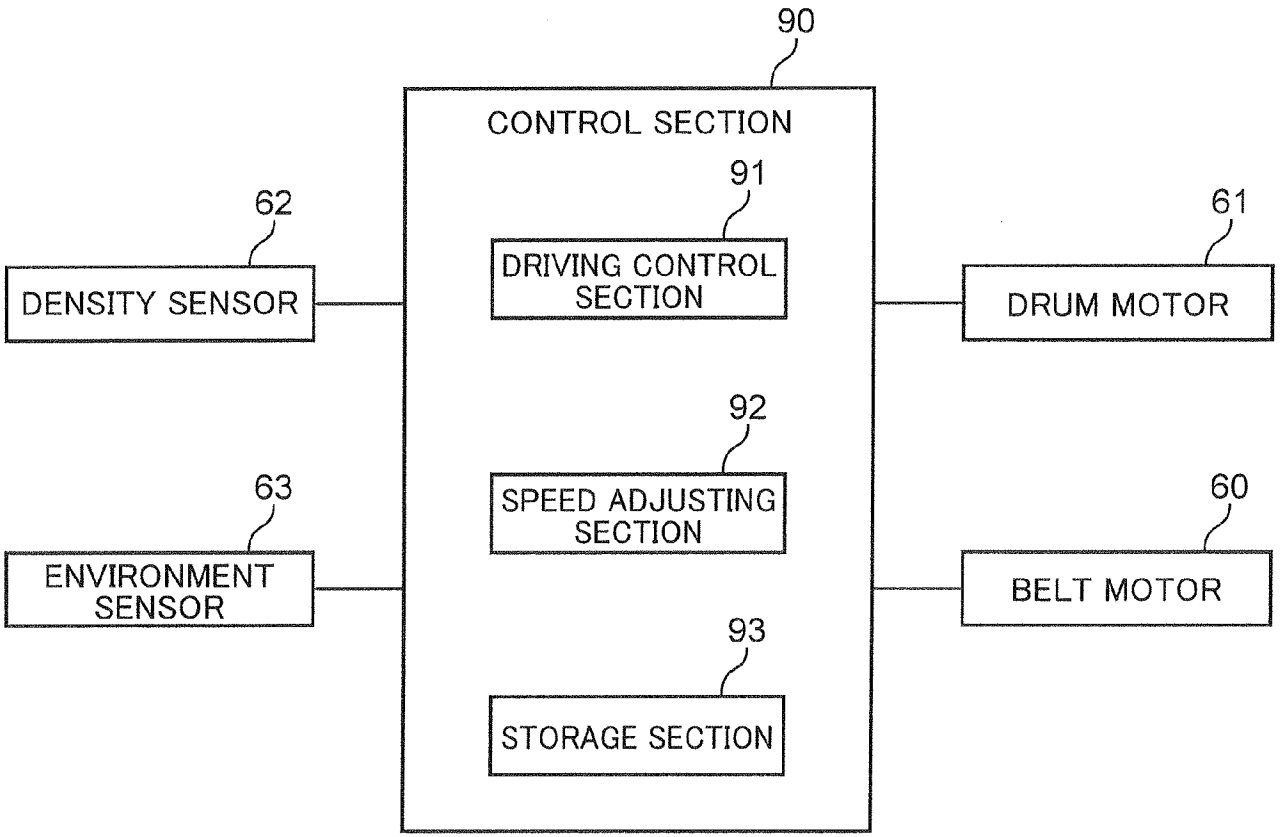
FIG. 3 is an electrical block diagram of a control section according to the embodiment of the disclosure.

As shown in FIG. 2, the intermediate transfer unit 14 further includes a first backup roller 146 (backup roller), a second backup roller 147, a belt motor 60, a density sensor 62, an environment sensor 63, and a control section 90 (FIG. 3).

The first backup roller 146 is disposed between the driving roller 142 and the primary transfer roller 24Bk, positioned on the most downstream side among the plurality of primary transfer rollers 24 in the circumferential rotating direction of the intermediate transfer belt 141. The intermediate transfer belt 141 is stretched and supported around the first backup roller 146. More specifically, the intermediate transfer belt 141 is stretched around a peripheral surface of the first backup roller 146 at a predetermined angle. Likewise, the second backup roller 147 is disposed between the driven roller 143 and the primary transfer roller 24M, positioned on the most upstream side among the plurality of primary transfer rollers 24 in the circumferential rotating direction of the intermediate transfer belt 141. The intermediate transfer belt 141 is stretched and supported around the second backup roller 147. The first backup roller 146 and the second backup roller 147 support the intermediate transfer belt 141 to linearly arrange the plurality of primary transfer nip portions. When the image forming apparatus 10 is not in operation, the primary transfer rollers 24 for the respective colors and the second backup roller 147 can move toward the inside of the intermediate transfer belt 141. That is, the primary transfer roller 24 can be separated from the photosensitive drum 20. At this time, the intermediate transfer belt 141 is stretched and supported between the first backup roller 146 and the driven roller 143. When the primary transfer roller 24 is separate from the photosensitive drum 20, the intermediate transfer belt 141 or the photosensitive drum 20 can be installed in and removed from the apparatus main body 11 without bringing the intermediate transfer belt 141 and the photosensitive drum 20 into contact with each other.

The belt motor 60 generates a driving force for circumferentially rotating the intermediate transfer belt 141. The belt motor 60 transmits the rotational driving force to the driving roller 142. The belt motor 60 is controlled by a driving control section 91 described below to change the rotation speed of the driving roller 142.

The density sensor 62 (resistance detector) is disposed between the photosensitive drum 20Bk for black and the first backup roller 146 opposite a belt surface of the intermediate transfer belt 141. The density sensor 62 detects the density of the toner image formed on the intermediate transfer belt 141. Moreover, the density sensor 62 detects the density of the belt surface of the intermediate transfer belt 141. The density of the belt surface of the intermediate transfer belt 141 detected by the density sensor 62 is referenced by a speed adjusting section 92 to detect a change in the resistance value of the intermediate transfer belt 141.

The environment sensor 63 is provided in the apparatus main body 11 of the image forming apparatus 10 to detect ambient temperature and humidity. Temperature and humidity data detected by the environment sensor 63 is stored in a storage section 93 described below. Furthermore, the temperature and humidity data is referenced by the speed adjusting section 92 to determine whether or not to perform speed adjusting control on the intermediate transfer belt 141.

The control section 90 is configured by a central processing unit (CPU), read only memory (ROM) that stores control programs, random access memory (RAM) used as work areas for the CPU, or the like. FIG. 3 is an electrical block diagram of the control section 90. The control section 90 connects electrically to the belt motor 60, the drum motor 61, the density sensor 62, and the environment sensor 63. The CPU executes the control programs stored in the ROM to allow the control section 90 to function as the driving control section 91, the speed adjusting section 92 (speed ratio adjusting section), and a storage section 93, which are provided in the control section 90.

The driving control section 91 controls the drum motor 61 to change the rotation speed Vd of the photosensitive drum 20. The driving control section 91 also controls the belt motor 60 to change the circumferential rotating speed Vb of the intermediate transfer belt 141.

The speed adjusting section 92 controls the rotation speed of the driving roller 142 according to the results of detection by the environment sensor 63 and the density sensor 62 to adjust a speed ratio Vb/Vd between the circumferential rotating speed Vb of the intermediate transfer belt 141 and the rotation speed Vd of the photosensitive drum 20.

The storage section 93 stores a temperature threshold T0. The temperature threshold T0 is compared with a detected temperature T detected by the environment sensor 63 by the speed adjusting section 92. The storage section 93 also stores a density threshold D0 for the belt surface. The speed adjusting section 92 references and compares the density threshold D0 with a detected density D for the belt surface detected by the density sensor 62. According to another embodiment, the temperature threshold T0 may be a threshold for humidity or for a combination of temperature and humidity.

<Occurrence and Elimination of Color Misalignment>

Figure 4:
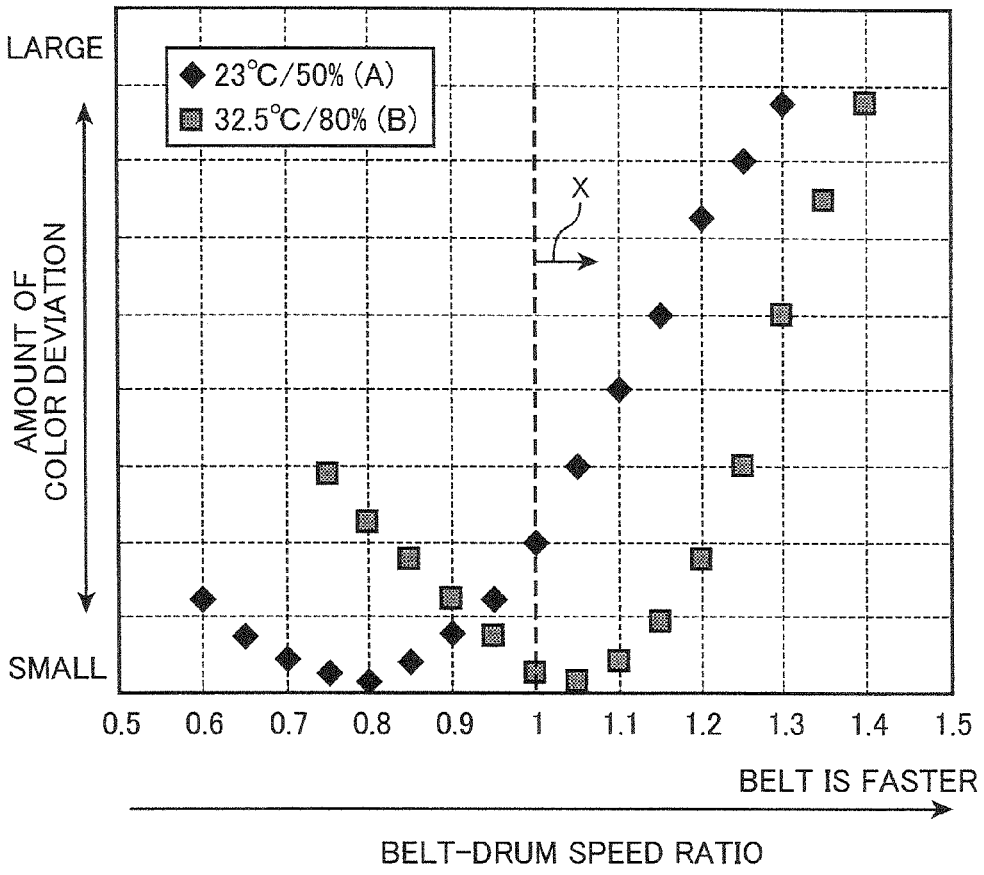
FIG. 4 is a graph showing a relation between color misalignment and the speed ratio between an intermediate transfer belt and a photosensitive drum.
Figure 5:
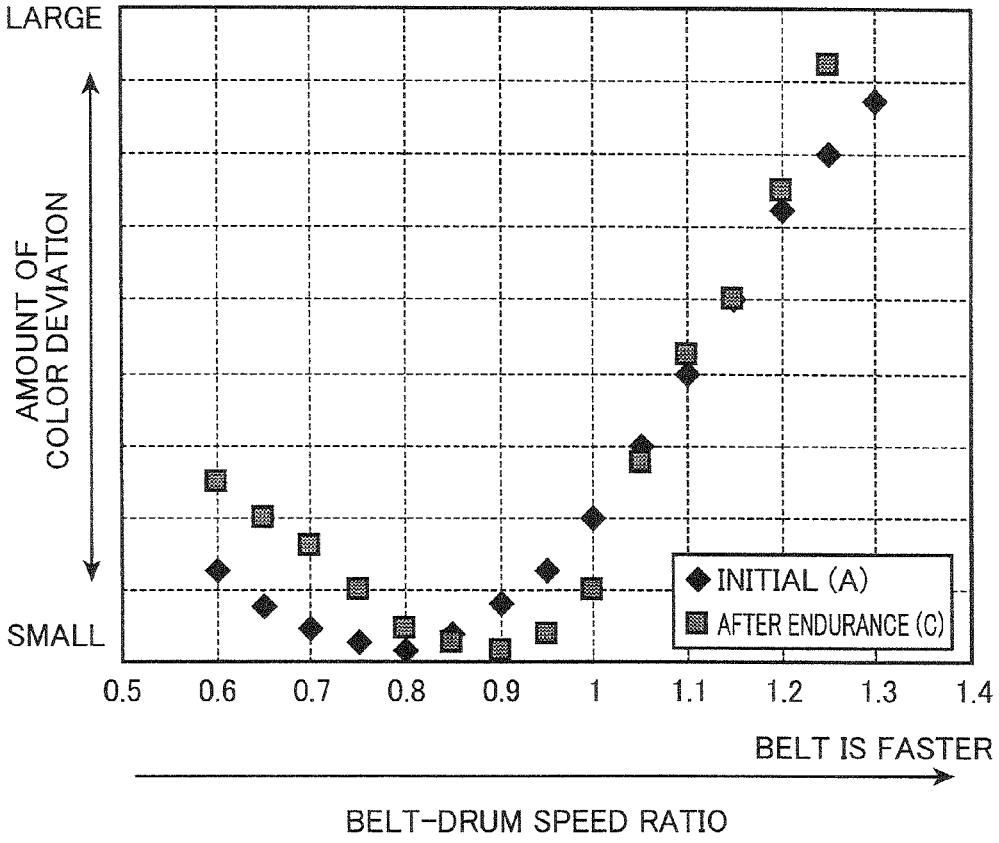
FIG. 5 is a graph showing the relation between color misalignment and the speed ratio between the intermediate transfer belt and the photosensitive drum.

Now, color misalignment that may occur on the intermediate transfer belt 141 will be described. FIG. 4 and FIG. 5 are graphs showing the relation between color misalignment and the speed ratio between the intermediate transfer belt 141 and the photosensitive drum 20. FIG. 4 is a diagram showing the occurrence level of color misalignment in different temperature and humidity environments in an initial stage of the use of the image forming apparatus 10. Furthermore, FIG. 5 is a graph showing the occurrence level of color misalignment before and after the surface of the intermediate transfer belt 141 is whitened as a result of the use of the image forming apparatus 10 for a predetermined period. The color misalignment means misalignment of toner images that may occur on the intermediate transfer belt 141 when the toner images are transferred from the photosensitive drum 20 to the intermediate transfer belt 141.

As described above, in the intermediate transfer unit 14 according to the present embodiment, the rotation speed of the driving roller 142 is changed to enable adjustment of the speed ratio Vb/Vd between the circumferential rotating speed Vb of the intermediate transfer belt 141 and the rotation speed Vd of the photosensitive drum 20. As shown in FIG. 4, in the initial stage of the use of the image forming apparatus 10, in other words, when no external additive for toner or the like is stuck to the surface of the intermediate transfer belt 141, possible color misalignment is suppressed in a normal temperature environment (A) (temperature: 23° C., humidity: 50%) in a region where the speed ratio Vb/Vd is lower than 1.0. More specifically, in a region where the speed ratio Vb/Vd is equal to or higher than 0.75 and equal to or lower than 0.85, the minimum value is present at which possible color misalignment is maximally suppressed.

On the other hand, in a high temperature environment (B) (temperature: 32.5° C., humidity: 80%), possible color misalignment is suppressed in a region where the speed ratio is Vb/Vd is higher than 1.0. More specifically, in a region where the speed ratio Vb/Vd is equal to or higher than 1.05 and equal to or lower than 1.15, the minimum value is present at which possible color misalignment is maximally suppressed.

As described above, in the present embodiment, a metal roller is used as the driving roller 142. In particular, the driving roller 142 includes the layer formed of alumite. Such a metal roller has its diameter changed by temperature or humidity less significantly than elastic rollers. This enables suppression of a variation in the speed of the intermediate transfer belt 141 associated with the change in diameter. On the other hand, slippage may occur intermediate transfer belt 141 between the metal roller and the inner peripheral surface of the intermediate transfer belt 141. Such slippage makes the circumferential rotational driving of the intermediate transfer belt 141 unstable, leading to an increased likelihood of the color misalignment. Moreover, the slippage between the driving roller 142 and the intermediate transfer belt 141 is likely to be significant in a high-temperature and high-humidity environment. Thus, in the high-temperature and high-humidity environment, the adverse effect of the slippage is premitigated to reduce the likelihood of color misalignment in a region where the intermediate transfer belt 141 is circumferentially and rotationally driven faster than the photosensitive drum 20 as shown in FIG. 4.

Moreover, the after endurance (C) in FIG. 5 means that the intermediate transfer belt 141 is used for a long period and is indicative of the occurrence level of color misalignment occurring when an external additive for toner adheres to the surface of the intermediate transfer belt 141. The after endurance (C) data has been obtained through evaluation in the above-described normal temperature environment. The initial (A) data in FIG. 5 corresponds to the data on the normal temperature environment (A) in FIG. 4. When the external additive for toner adheres to the surface of the intermediate transfer belt 141, the resistance value of the intermediate transfer belt 141 increases. This increases an attractive force exerted between the intermediate transfer belt 141 and the photosensitive drum 20. In this case, when the intermediate transfer belt 141 is circumferentially and rotationally driven faster than the photosensitive drum 20, the occurrence of color misalignment is actually observed because the speed is likely to vary under the attractive force. As shown in FIG. 5, the characteristics observed after endurance (C) tend to be more similar to the characteristics observed in the normal temperature environment (A) than to the characteristics observed in the above-described high temperature environment (B). Specifically, after endurance (C), possible color misalignment is suppressed in a region where the speed ratio Vb/Vd is lower than 1.0. More specifically, the minimum value at which possible color misalignment is maximally suppressed is present in a region where the speed ratio Vb/Vd is equal to or higher than 0.85 and equal to or lower than 0.95. Thus, after endurance (C), when the attractive force between the intermediate transfer belt 141 and the photosensitive drum 20 is likely to increase, color misalignment caused by the attractive force is suppressed by allowing the intermediate transfer belt 141 and the photosensitive drum 20 to rotate at an equal speed.

As described above, according to the present embodiment, the primary transfer roller 24 includes a retract mechanism, and the first backup roller 146 is disposed between the primary transfer roller 24Bk for black and the driving roller 142 (FIG. 2). The first backup roller 146 forms a horizontal and linear primary transfer area between the first backup roller 146 and the second backup roller 147. A secondary transfer area extending from a lower side to an upper side is formed between the driving roller 142 and the secondary transfer roller 145 by the first backup roller 146. The discloser has found that, in the normal temperature environment (A) in FIG. 4, toner splashes significantly in the secondary transfer area when the speed ratio Vb/Vd is equal to or higher than 1.0 (area X in FIG. 4). In a manufacture stage of the intermediate transfer belt 141, a memory corresponding to a curved portion of the belt surface of the intermediate transfer belt 141 may remain on the belt surface. When the intermediate transfer belt 141 is circumferentially and rotationally driven faster than the photosensitive drum 20, splash of toner is observed because the memory on the belt surface is emphasized between the driving roller 142 and the first backup roller 146 to change the behavior of the belt in the secondary transfer area.

<Adjustment of the Speed Ratio Vb/Vd>

Figure 6:
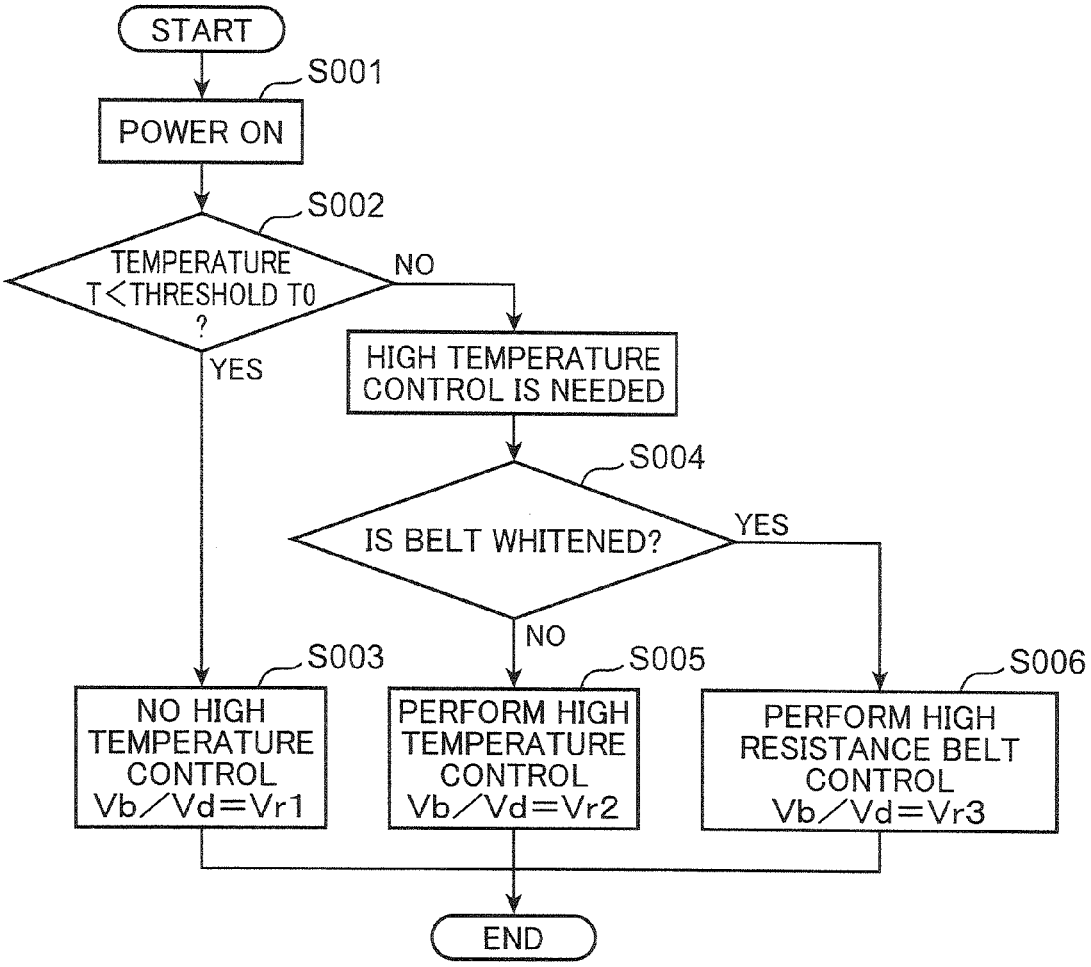
FIG. 6 is a flowchart showing a control aspect of driving control according to the embodiment of the disclosure.

To solve the above-described problems, the speed adjusting section 92 adjusts the speed ratio Vb/Vd according to the present embodiment. Speed control will be described which is performed by the speed adjusting section 92 in the intermediate transfer unit 14 according to the present embodiment. FIG. 6 is a flowchart showing a control aspect of the speed control according to the present embodiment.

When the image forming apparatus 10 is turned on (step S001), the speed adjusting section 92 determines whether or not to adjust the speed ratio Vb/Vd between the circumferential rotating speed Vb of the intermediate transfer belt 141 and the rotation speed Vd of the photosensitive drum 20. The speed adjusting section 92 compares a detected temperature T detected by the environment sensor 63 with a temperature threshold T0 prestored in the storage section 93 (step S002). According to the present embodiment, the temperature threshold T0 is set to 28° C. by way of example. If the detected temperature T is lower than the temperature threshold T0 (YES in step S002), the speed adjusting section 92 determines that high temperature control on the speed ratio Vb/Vd is unnecessary. In this case, the speed adjusting section 92 sets the speed ratio Vb/Vd to Vr1 (first speed ratio). Based on the data on the normal temperature environment (A) in FIG. 4 described above, Vr1 is set to lower than 1.0. More preferably, Vr1 is set equal to or higher than 0.75 and equal to or lower than 0.85. As a result, in the normal temperature environment, a toner image formed on the intermediate transfer belt 141 is suitably inhibited from being subjected to color misalignment. Moreover, even if the curved memory is present on the belt surface, the splash of toner in the secondary transfer area is inhibited by setting Vr1 to lower than 1.0.

On the other hand, if the detected temperature T is equal to or higher than the temperature threshold T0 (NO in step S002), the speed adjusting section 92 determines that the high temperature control on the speed ratio Vb/Vd needs to be performed. In this case, the speed adjusting section 92 further checks the belt for whitening (step S004). That is, the speed adjusting section 92 compares the detected density D of the belt surface detected by the density sensor 62 with a density threshold D0 stored in advance in the storage section 93. The surface of the intermediate transfer belt 141 is normally black but is whitened when the external additive for toner is attached to the surface. The density threshold D0 is preset in association with the density of the whitened belt surface of the intermediate transfer belt 141. If the result of the comparison of the detected density D indicates that the belt surface of the intermediate transfer belt 141 has not been whitened (NO in step S004), the speed adjusting section 92 performs the high temperature control on the speed ratio Vb/Vd in association with the normal belt surface. In this case, the speed adjusting section 92 sets the speed ratio Vb/Vd to Vr2 (second speed ratio) (step S005). Based on the data on the high temperature environment (B) in FIG. 4 described above, Vr2 is set equal to or higher than 1.0. More preferably, Vr2 is set equal to or higher than 1.05 and equal to or lower than 1.15. As a result, in the high temperature environment, the toner image formed on the intermediate transfer belt 141 is suitably inhibited from being subjected to color misalignment.

Moreover, if the result of comparison of the detected density D indicates that the belt surface of the intermediate transfer belt 141 is whitened (YES in step S004), the speed adjusting section 92 performs high resistance control on the speed ratio Vb/Vd in association with the whitened belt surface. In this case, the speed adjusting section 92 sets the speed ratio Vb/Vd to Vr3 (third speed ratio) in preference to the above-described Vr2 (step S006). Based on the after endurance (C) data in FIG. 5, Vr3 is set to lower than 1.0. More preferably, Vr3 is set equal to or higher than 0.85 and equal to or lower than 0.95. As a result, even if the belt surface of the intermediate transfer belt 141 is whitened, the toner image formed on the intermediate transfer belt 141 is suitably inhibited from being subjected to color misalignment.

As described above, the intermediate transfer belt 141 is disposed opposite the plurality of photosensitive drums 20 rotationally driven at an equal speed. The rotation speed of the driving roller 142, which circumferentially and rotationally drives the intermediate transfer belt 141, is controlled to adjust the speed ratio Vb/Vd between the circumferential rotating speed Vb of the intermediate transfer belt 141 and the rotation speed Vd of the photosensitive drum 20. Thus, the speed ratio Vb/Vd can be adjusted using a simpler configuration than in a case where the rotation speeds of the plurality of photosensitive drums 20 are individually adjusted. Furthermore, the speed adjusting section 92 adjusts the speed ratio according to the results of detection by the environment sensor 63 and the density sensor 62. Thus, the speed ratio can be adjusted if the likelihood of slippage between the intermediate transfer belt 141 and the driving roller 142 changes in conjunction with a change in the environment or the attractive force exerted between the intermediate transfer belt 141 and the photosensitive drum 20 changes in conjunction with a change in the resistance value of the intermediate transfer belt 141. This enables the toner image transferred from the photosensitive drum 20 to the intermediate transfer belt 141 to be inhibited from undergoing color misalignment as a result of a change in the likelihood of slippage or the attractive force.

In particular, when the temperature or humidity detected by the environment sensor 63 is equal to or higher than the predetermined threshold, the second speed ratio Vr2, which is higher than the first speed ratio Vr1, is set. Thus, in the high temperature or humidity environment, the toner image is suitably inhibited from being subjected to color misalignment even if the intermediate transfer belt 141 and the driving roller 142 are likely to slip with respect to each other.

Furthermore, when the density sensor 62 detects that the resistance value of the intermediate transfer belt 141 has increased above a preset threshold, a third speed ratio Vr3 is set which is higher than the first speed ratio Vr1 and lower than the second speed ratio Vr2. That is, when the resistance value of the intermediate transfer belt 141 rises to increase the attractive force exerted between the intermediate transfer belt 141 and the photosensitive drum 20, the third speed ratio Vr3 is set, which is lower than the second speed ratio Vr2 for the high temperature or humidity environment. Thus, even when the circumferential rotating speed of the intermediate transfer belt 141 is likely to vary as a result of an increase in the attractive force, the speed ratio is inhibited from being set to an excessively large value. This inhibits color misalignment caused by a variation in the circumferential rotating speed.

Furthermore, the density sensor 62 functions as a resistance detecting section. Thus, the density sensor 62 suitably detects that the resistance value of the intermediate transfer belt 141 is changed by attachment of the external additive for toner or the like to the belt surface of the intermediate transfer belt 141. In this case, the density sensor 62 serves both as a mechanism that detects a change in the resistance value of the intermediate transfer belt 141 and as a mechanism that detects the density of the toner image on the intermediate transfer belt 141.

Additionally, the metal roller used as the driving roller 142 can be inhibited from having its diameter changed depending on temperature or humidity, compared to elastic rollers. This enables inhibition of a variation in the speed of the intermediate transfer belt 141 associated with the change in diameter. In addition, even when the metal roller and the intermediate transfer belt 141 are likely to slip with respect to each other, the speed ratio between the intermediate transfer belt 141 and the photosensitive drum 20 can be adjusted. Moreover, the driving roller 142, including the alumite layer, and the intermediate transfer belt 141 are likely to electostatically attract each other. Hence, the rotational driving force of the driving roller 142 is stably transmitted to the intermediate transfer belt 141.

Furthermore, in a relatively low temperature or humidity environment, the intermediate transfer belt 141 is inhibited from being circumferentially and rotationally driven faster than the photosensitive drum 20. This restrains excessive tension from being applied to the belt surface between the first backup roller 146 and the driving roller 142. Thus, even when, in the manufacture of the intermediate transfer belt 141, a memory corresponding to a curved portion of the belt surface remains, the memory is prevented from appearing at the secondary transfer nip due to the tension. This inhibits possible splash of toner.

Additionally, in the image forming apparatus 10 including the intermediate transfer unit 14 according to the embodiment, the toner image transferred onto the sheet is inhibited from being subjected to color misalignment.

One embodiment of the disclosure has been described in detail, but the disclosure is not limited to this embodiment. The disclosure may include, for example, variations described below.

(1) The environment sensor 97 is not limited to the detection of the temperature or humidity around the intermediate transfer belt 141 inside the image forming apparatus 10. In a variation, the environment sensor may detect the temperature or humidity of an environment around an installation site of the image forming apparatus 10.

(2) Furthermore, in the embodiment, a change (an increase) in the resistance value of the intermediate transfer belt 141 is detected based on the whitening of the belt surface, but the disclosure is not limited to this. The disclosure includes the belt surface the color of which is changed to another color depending on the material composition of the intermediate transfer belt 141 when attachment adheres to the belt surface. The density threshold D0 may be set according to the change in color. Additionally, the disclosure is not limited to the detection of a change in the resistance value of the intermediate transfer belt 141 based on the density of the belt surface. Another resistance detecting section (not shown in the drawings) may directly detect the resistance value of the intermediate transfer belt 141.

(3) Furthermore, in the embodiment, the following aspect has been described. That is, when the image forming apparatus 10 is powered on, the speed adjusting section 92 determines whether or not to adjust the speed ratio Vb/Vd between the circumferential rotating speed Vb of the intermediate transfer belt 141 and the rotation speed Vd of the photosensitive drum 20. However, the disclosure is not limited to this aspect. The speed ratio Vb/Vd may be adjusted when each print job for the image forming apparatus 10 is started or when an image quality adjusting operation is performed.

(4) Additionally, in the embodiment, the following aspect has been described with reference to FIG. 6. That is, when the detected temperature T is lower than the temperature threshold T0 (YES in step S002), the speed adjusting section 92 determines that the high temperature control need not be performed on the speed ratio Vb/Vd. The disclosure is not limited to this aspect. After determining that the high temperature control need not be performed on the speed ratio Vb/Vd, the speed adjusting section 92 may further check the belt for whitening as in the case of step S004 and adjust the speed ratio Vb/Vd according to the result of the check.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A transfer device comprising:

an intermediate transfer belt disposed to face a plurality of image carriers each carrying a toner image on a circumferential surface of the image carrier and moreover rotationally driven at an equal speed, the intermediate transfer belt being circumferentially and rotationally driven in one direction, the toner images being transferred from the plurality of image carriers onto a surface of the intermediate transfer belt in a superimposed manner;

a driving roller around which the intermediate transfer belt is supported and which circumferentially and rotationally drives the intermediate transfer belt;

an environment sensor detecting a temperature or a humidity around the intermediate transfer belt;

a density detecting section detecting a density of a belt surface of the intermediate transfer belt; and a speed ratio adjusting section controlling a rotation speed of the driving roller according to results of detection by the environment sensor and the density detecting section, thereby adjusting a speed ratio Vb/Vd between a circumferential rotating speed Vb of the intermediate transfer belt and a rotation speed Vd of the image carrier, wherein the speed ratio adjusting section:

sets the speed ratio Vb/Vd to a first speed ratio when the temperature or humidity detected by the environment sensor is lower than a preset threshold, sets the speed ratio Vb/Vd to a second speed ratio that is higher than the first speed ratio when the temperature or humidity is equal to or higher than a preset threshold, and sets the speed ratio Vb/Vd to a third speed ratio that is higher than the first speed ratio and lower than the second speed ratio when the density detecting section detects that the density of the belt surface of the intermediate transfer belt is greater than a preset threshold.

2. The transfer device according to claim 1, wherein the first speed ratio is lower than 1.0.

3. The transfer device according to claim 2, wherein the first speed ratio is equal to or higher than 0.75 and equal to or lower than 0.85.

4. The transfer device according to claim 2, wherein the second speed ratio is equal to or higher than 1.0.

5. The transfer device according to claim 4, wherein the second speed ratio is equal to or higher than 1.05 and equal to or IHim and him and him and him lower than 1.15.

6. The transfer device according to claim 1, wherein the third speed ratio is lower than 1.0.

7. The transfer device according to claim 6, wherein the third speed ratio is equal to or higher than 0.85 and equal to or lower than 0.95.

8. The transfer device according to claim 1, wherein the density detecting section also serves as a toner density sensor that detects a density of a toner image formed on the intermediate transfer belt.

9. The transfer device according to claim 1, wherein the driving roller is a metal roller.

10. The transfer device according to claim 9, wherein the driving roller includes a layer disposed on a surface of the driving roller and formed of alumite.

11. The transfer device according to claim 2, further comprising:

a plurality of primary transfer rollers each disposed to face the image carrier across the intermediate transfer belt and forming a transfer nip between the primary transfer roller and the image carrier;

the driving roller forming a secondary transfer nip where the toner image is transferred from the intermediate transfer belt to a sheet; and a backup roller disposed between the driving roller and the primary transfer roller located on a most downstream side among the plurality of primary transfer rollers in the circumferential rotating direction of the intermediate transfer belt, the intermediate transfer belt being supported around the backup roller.

12. The transfer device according to claim 1, wherein the speed ratio adjusting section determines that the resistance value of the intermediate transfer belt is greater than the preset threshold when the density detectinq section detects that the belt surface is whitened.

13. An image forming apparatus comprising:

a transfer device having an intermediate transfer belt;

a plurality of image carriers each disposed to face the intermediate transfer belt and carrying a toner image on a peripheral surface of the image carrier and moreover rotationally driven at an equal speed; and a secondary transfer roller transferring the toner image from the intermediate transfer belt to a sheet, wherein the transfer device includes:

an intermediate transfer belt circumferentially and rotationally driven in one direction, the toner images being transferred from the plurality of image carriers onto a surface of the intermediate transfer belt in a superimposed manner;

a driving roller around which the intermediate transfer belt is supported and which circumferentially and rotationally drives the intermediate transfer belt;

an environment sensor detecting a temperature or a humidity around the intermediate transfer belt;

a density detecting section detecting a density of a belt surface of the intermediate transfer belt; and a speed ratio adjusting section controlling a rotation speed of the driving roller according to results of detection by the environment sensor and the density detecting section, thereby adjusting a speed ratio Vb/Vd between a circumferential rotating speed Vb of the intermediate transfer belt and a rotation speed Vd of the image carrier, wherein the speed ratio adjusting section:

sets the speed ratio Vb/Vd to a first speed ratio when the temperature or humidity detected by the environment sensor is lower than a preset threshold, sets the speed ratio Vb/Vd to a second speed ratio that is higher than the first speed ratio when the temperature or humidity is equal to or higher than a preset threshold, and sets the speed ratio Vb/Vd to a third speed ratio that is higher than the first speed ratio and lower than the second speed ratio when the density detecting section detects that the density of the belt surface of the intermediate transfer belt is greater than a preset threshold.

14. The image forming apparatus according to claim 13, wherein the driving roller is a metal roller.

* * * * *